US008528838B2

(12) United States Patent
Imenez et al.

(10) Patent No.: US 8,528,838 B2
(45) Date of Patent: Sep. 10, 2013

(54) PUSH-BUTTON FOR A PRESSURIZED LIQUID DISTRIBUTION SYSTEM

(75) Inventors: Herve Imenez, Eu (FR); Jean-Pierre Songbe, Eu (FR)

(73) Assignee: Rexam Dispensing Systems S.A.S. (FR)

( * ) Notice: Subject to any disclaimer, the term of this patent is extended or adjusted under 35 U.S.C. 154(b) by 611 days.

(21) Appl. No.: 12/728,731

(22) Filed: Mar. 22, 2010

(65) Prior Publication Data

US 2010/0237172 A1 Sep. 23, 2010

(30) Foreign Application Priority Data

Mar. 23, 2009 (FR) ..... 09 01358

(51) Int. Cl.
*B05B 7/32* (2006.01)

(52) U.S. Cl.
USPC ..... 239/337; 239/482; 239/487; 239/489; 239/491; 239/543

(58) Field of Classification Search
USPC ..... 239/333, 337, 482, 487–489, 491, 239/543
See application file for complete search history.

(56) References Cited

U.S. PATENT DOCUMENTS 4,109,869 A * 8/1978 Brockelsby et al. ..... 239/491
4,187,985 A * 2/1980 Goth ..... 239/337
4,991,778 A * 2/1991 Maas et al. ..... 239/333
5,779,156 A * 7/1998 Crampton ..... 239/543
2003/0230641 A1 12/2003 Foster et al.
2007/0051831 A1 3/2007 Kuo

FOREIGN PATENT DOCUMENTS

FR 2903328 A1 1/2008
FR 2915470 A1 10/2008

OTHER PUBLICATIONS

French Search Report and Written Opinion on the Patentability of Invention; FR 0901358; Aug. 21, 2009; 7 pages.

* cited by examiner

*Primary Examiner* — Steven J Ganey
(74) *Attorney, Agent, or Firm* — St. Onge Steward Johnston & Rees LLC

(57) ABSTRACT

A push-button for a pressurised liquid distribution system, the push-button including a body onto which an end piece is mounted around an insert so as to form a distribution chamber between said end piece and the insert, the distribution chamber being in communication with a supply channel intended to be mounted on a feed tube for the pressurised liquid, the distribution chamber being successively connected to upstream channels, downstream channels and distribution channels, the distribution channels each converging towards an outlet opening while being designed to enable the impaction of the liquid jets dispensed by the openings, the upstream and downstream channels extending longitudinally while forming an upstream and downstream fluid flow section, respectively, in the distribution chamber, the downstream section having an average transverse surface which is less than the average transverse surface of the upstream section.

16 Claims, 5 Drawing Sheets

PUSH-BUTTON FOR A PRESSURIZED LIQUID DISTRIBUTION SYSTEM

CROSS-REFERENCE TO RELATED APPLICATIONS

The present application claims priority of French patent application No. 09 01358 filed on Mar. 23, 2009, the content of which is incorporated herein by reference.

FIELD OF THE INVENTION

The invention relates to a push-button for a pressurised liquid distribution system, as well as such a distribution system.

BACKGROUND OF THE INVENTION

In one particular application, the distribution system is intended to equip bottles used in perfumery, cosmetics or for pharmaceutical treatments. As a matter of fact, this type of bottle contains a liquid which is delivered under pressure by a manually operated pump or valve by means of a push-button which is designed to enable spraying of the liquid.

Such push-buttons are conventionally made in two parts: an operating body and a spray nozzle that are combined together to form the push-button. In particular, the spray nozzle can be designed so as to form an aerosol with the liquid, in particular by defining a so-called vortex chamber.

To accomplish this, the vortex chamber is designed to make the liquid spin very rapidly so as to give it speed. Thus, by providing for the vortex chamber to be extended at the centre thereof via a distribution opening, the liquid can escape at high speed while fractionating itself into fine droplets forming the aerosol.

However, since this fractionation occurs in an uncontrolled manner, the aerosol consists of droplets of widely varied sizes. For example, for a pump or a valve supplying a push-button with a stream of alcohol under a pressure of 5 bars, and a 0.3-mm outlet opening, the aerosol commonly consists of droplets having a diameter of between 5 μm and 300 μm.

Such being the case, the large droplets are heavier than the smaller ones and follow a different distribution path, and are capable of causing indelible stains in the case of perfumes. Therefore, the small droplets are the lightest ones and can be inhaled, which may be the desired objective in the case of medications, but which can have an undesirable effect in the case of toxic products. Furthermore, in the case of medications which must be dispensed according to a precise dosage regimen, the location of application, e.g. inside the respiratory system, depends on the size of the droplets, and the large disparity in sizes distorts the treatment.

Furthermore, the size of the droplets derived from a vortex chamber depends in part on the force and speed with which the user operates the pump by pressing on the push-button with his finger, because the pressure induced depends on it.

Furthermore, and in particular because of the effects of the centrifugal force at the outlet of the vortex chamber, the aerosol has a tendency to be hollow with a substantially conical envelope which consists of the majority of the droplets, while there are few of same on the inside of the cone. In particular, this distribution of the droplets can be harmful in the case of dermal applications.

In order to solve the aforementioned problems, in particular the document FR-2 903 328 proposes to use a non-vortex nozzle which is provided with a micro-screen to ensure the calibration and spatial distribution of the droplets.

However, this embodiment necessitates flow areas through the micro-screen which are extremely small, in particular of the order of 6 μm in diameter, which requires fine filtration of the liquid in order to avoid clogging problems. Furthermore, the difficulty of producing and assembling these micro-screens in the body remains considerable.

A push-button is also known, in particular from the document FR-2 915 470, which includes a distribution chamber which is provided with channels each converging towards an outlet opening, said convergent channels being designed to enable the impaction of the liquid jets dispensed by said openings. Thus, during the impaction of the jets dispensed at high speed, an aerosol is formed, without the use of a vortex chamber.

In order to supply the convergent channels with liquid, the prior art proposes to equip the distribution chamber with an annular channel from which said convergent channels extend. This solution enables distribution of the streams of liquid introduced into each channel but poses a certain number of problems.

In particular, the liquid introduced into the annular channel under pressure becomes turbulent, which does not enable the streams of liquid introduced into the convergent channels to be stabilised. Furthermore, the speed of the liquid stream introduced remains low, which, while limiting the impaction energy of the liquid jets dispensed, does not enable an aerosol of optimum quality to be produced, in particular with respect to the fineness, calibration and spatial distribution of the droplets comprised in the same.

In addition, the supplying of the convergent channels according to the prior art does not enable fractionation of the dose of liquid to be dispensed, i.e. delivery of only a portion of the dose provided by the pump. As a matter of fact, the bearing-down stroke of the push-button is carried out too quickly, in particular of the order of 0.2 second for 100 μl, in order to be capable of being interrupted by the user.

The invention aims to solve the problems of the prior art, in particular by proposing a push-button which enables the dispensing of an aerosol formed of droplets having improved calibration and spatial distribution, and does so while increasing the production time for said aerosol.

SUMMARY OF THE INVENTION

To that end, and according to a first aspect, the invention proposes a push-button for a pressurised liquid distribution system, said push-button comprising a body onto which an end piece is mounted around an insert so as to form a distribution chamber between said end piece and said insert, said distribution chamber being in communication with a supply channel intended to be mounted on a feed tube for the pressurised liquid, said distribution chamber being successively connected to upstream channels, downstream channels and distribution channels, said distribution channels each converging towards an outlet opening while being designed to enable the impaction of the liquid jets dispensed by said openings, the upstream and downstream channels extending longitudinally while forming an upstream and downstream fluid flow section, respectively, in the distribution chamber, said downstream section having an average transverse surface which is less than the average transverse surface of the upstream section.

According to a second aspect, the invention proposes a pressurised liquid distribution system comprising a pressurised device for withdrawing the liquid, on which such a push-button is mounted, the distribution chamber being in communication with the feed tube for the pressurised liquid coming from said withdrawing device, so as to enable the liquid to be sprayed via impaction of the jets coming from the distribution channels.

BRIEF DESCRIPTION OF THE DRAWINGS

Other objects and advantages of the invention will become apparent in the following description, which is made with reference to the appended figures, in which.

DETAILED DESCRIPTION OF THE INVENTION

A push-button 1 for a pressurised liquid distribution system is described below in connection with the figures, said liquid potentially being of any type, which is used, in particular, in perfumery, cosmetics or for pharmaceutical treatments.

The distribution system likewise includes a pressurised device 2 for withdrawing the liquid, which is operated manually by means of the push-button 1. In particular, the withdrawing device 2 can include a pump or a valve, in the case where the liquid is packaged under pressure.

Figure 1:
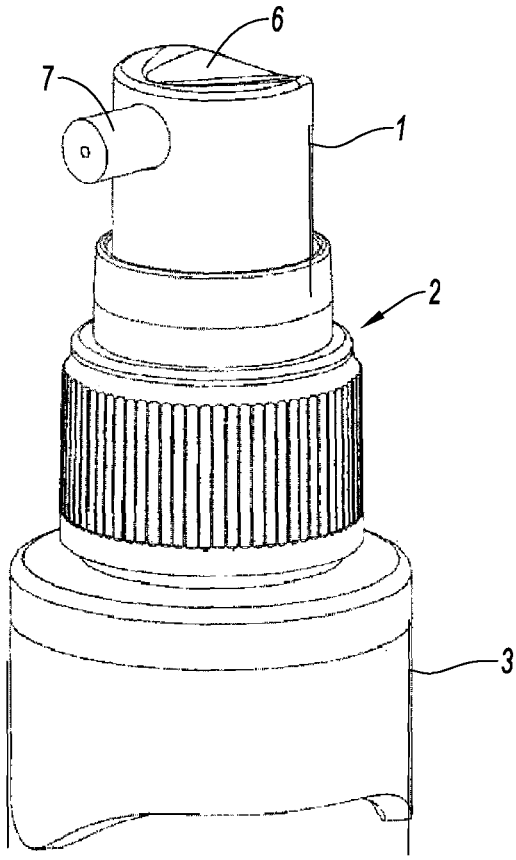
FIG. 1 is a partial perspective view of a distribution system according to the invention, said system being mounted on the mouth of a bottle.
Figure 2:
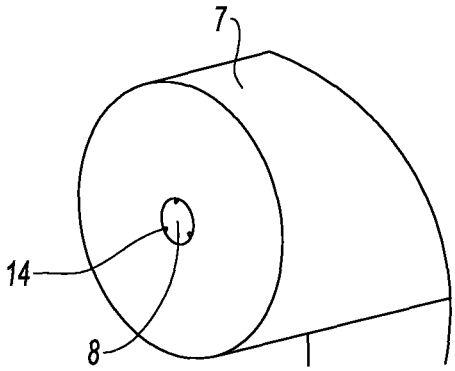
FIG. 2 is an enlarged view of FIG. 1 showing the dispensing end of the push-button.

In connection with FIG. 1, the push-button 1 is mounted on a feed tube for the pressurised liquid coming from the withdrawing device 2, the distribution system being mounted on the mouth of a bottle 3 containing the liquid so as to supply the push-button 1 with said pressurised liquid.

The push-button 1 includes a body having an annular-like skirt 4, which surrounds a housing 5 for mounting onto the feed tube for the pressurised liquid. In addition, the push-button 1 includes an upper region 6 enabling the user to exert finger pressure on said push-button so as to be capable of moving same axially in order to actuate the withdrawing device 2.

The push-button 1 likewise includes an end piece 7, which is mounted around an insert 8 so as to form a distribution chamber between said end piece and said insert. In the embodiments shown, the body of the push-button 1 has a housing 9 in which the insert 8 is arranged in order to enable the liquid to be sprayed laterally relative to the body of said push-button.

Figure 3A:
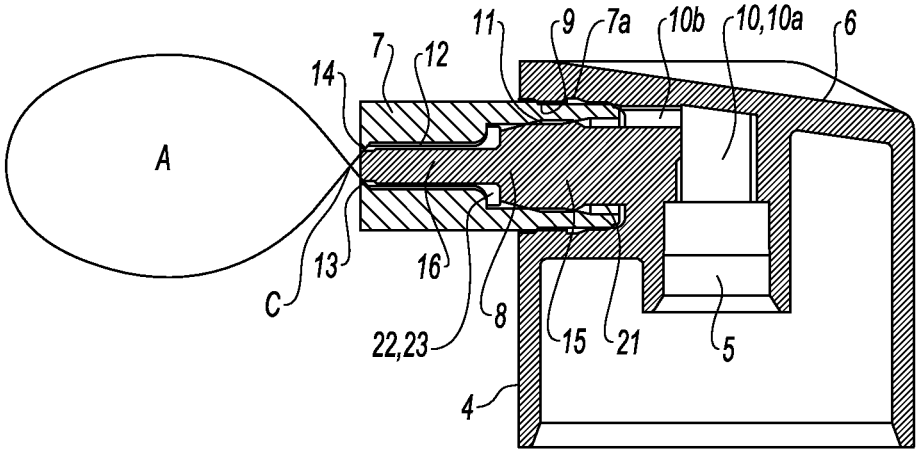
FIG. 3 are longitudinal sectional views of a push-button according to an embodiment of the invention, respectively, in which the envelope of the dispensed liquid is diagrammed.
Figure 3B:
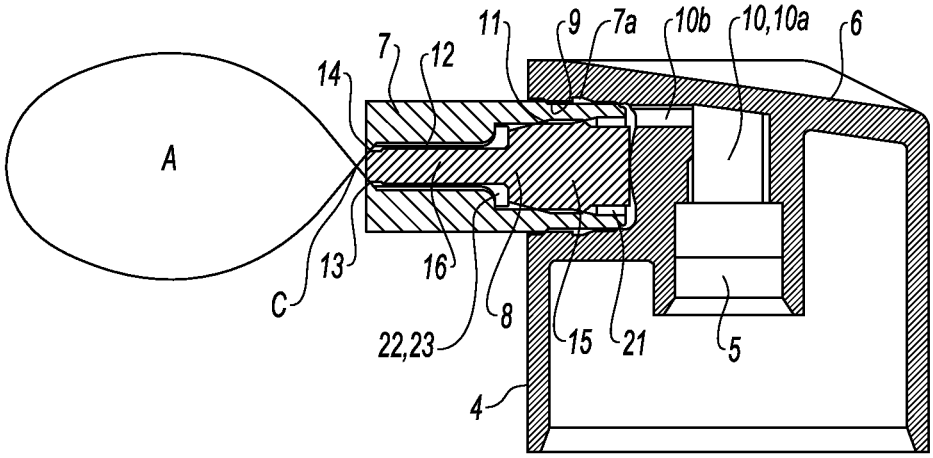
Figure 8:
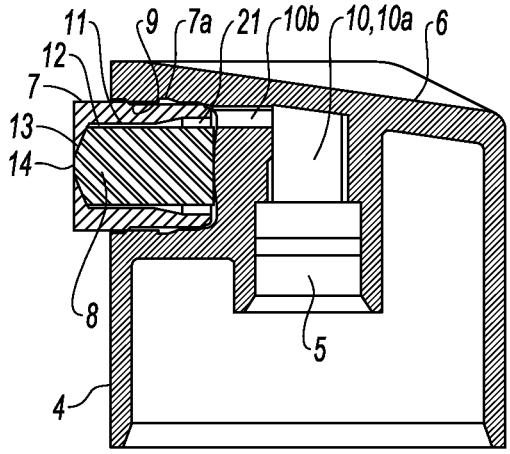
FIG. 8 is a longitudinal sectional view of a push-button according to another embodiment of the invention.

The insert 8 can be made integral with the body of the push-button 1 (FIG. 3*a*) or inserted into the housing 9 (FIGS. 3*b*, 8). In addition, the exterior wall of the end piece 7 has an anchoring ring 7*a* in the wall of the housing 9 so as to enable said end piece to be connected in said housing.

The distribution chamber is in communication with a supply channel 10 the upstream portion 10*a* of which terminates in the housing 5 for mounting onto the feed tube for the pressurised liquid. In the embodiments shown, the upstream portion 10*a* is coaxial with the housing 5 and the supply channel 10 has a downstream portion 10*b*, which is perpendicular to said housing. According to another embodiment, e.g. for a nosepiece, the downstream portion 10*b* can have an axis which is parallel to that of the upstream portion 10*a*.

The distribution chamber is successively connected to upstream channels 11, downstream channels 12 and distribution channels 13. In order to enable the liquid to be sprayed while forming an aerosol, the distribution channels 13 each converge towards an outlet opening 14, while being designed to enable the impaction of the liquid jets dispensed by said openings. In particular, the distribution channels 13 can converge at a point C, at an angle of the order of 70°, so as to produce the aerosol A in immediate proximity to the outlet openings 14.

In the figures, the upstream 11 and downstream 12 channels are formed in the free space which is formed at the interface between an interior wall of the end piece 7 and an exterior wall of the insert 8, a concave impression being formed on at least one of said walls so as to be closed by the other wall while defining said channels.

In particular, the impression can be made concave on one wall, and the other wall has a complementary surface which closes said concavities radially so as to form the channels 11, 12 along said concavities. In the embodiments shown, the concavities are made on the exterior wall of the insert 8, and the interior wall of the end piece 7 is rotating, however the reverse configuration is foreseeable.

In FIGS. 1 to 7, the insert 8 has a base 15 over which a rod 16 extends, the exterior wall of said insert then comprising an upstream bearing surface 15*a* formed around said base and a downstream bearing surface 16*a* formed around said rod. Furthermore, the outside diameter of the upstream bearing surface 15*a* of the base 15 is greater than the outside diameter of the downstream bearing surface 16*a* of the rod 16.

In the same way, the interior wall of the end piece 7 has an upstream bearing surface 17 and a downstream bearing surface 18 which are arranged opposite to those of the insert 8, in order to form therebetween the upstream 11 and downstream 12 channels, respectively. In particular, the inside diameter of the upstream bearing surface 17 is greater than the inside diameter of the downstream bearing surface 18.

Two embodiments are described below, in connection with FIGS. 4 to 7, for forming the upstream channels 11 around the base 15 and the downstream channels 12 around the rod 16. The upstream 11 and downstream 12 channels extend longitudinally over the bearing surfaces 15*a*, 16*a* while forming an upstream and downstream flow area, respectively, for the fluid in the distribution chamber, said areas having an average transverse surface which corresponds to the average of the transverse surfaces across which the fluid flows in the channels 11, 12. In particular, the transverse surface of the upstream and downstream areas corresponds to the sum of the transverse surfaces of the upstream 11 and downstream 12 channels, respectively.

The invention provides for the average transverse surface of the downstream area to be less than the average transverse surface of the upstream area. Thus, the speed of the liquid increases from upstream to downstream so as to be capable of supplying the convergent channels 13 with a liquid flow the speed of which is considerable. This results in a significant degree of impaction energy, thereby enabling production of an aerosol A consisting of a uniform spatial distribution of airborne droplets, the size of said droplets being small and uniform. In particular, the aerosol A may then have the appearance of a plume of smoke.

Furthermore, due to the passage of the liquid in a downstream area having a small transverse surface compared to that of the upstream area, the distribution time of a dose of liquid over the operating stroke of the push-button 1 is increased. In particular, the distribution time for a 100-μl dose may be between 0.5 and 2 seconds, so as to allow the user the possibility of interrupting the dispensing of the aerosol A during operation.

The upstream bearing surface 15*a* of the base 15 has knurls 19 which extend longitudinally in relief over the cylindrical rotating surface of said bearing surface, an upstream channel 11 being formed between two adjacent knurls 19. Each knurl 19 has a central region 19*a* the outside diameter of which corresponds substantially to that of the upstream bearing surface 17 of the end piece 7, so as to enable said end piece to be centred over and fitted onto said knurls.

Upstream from the knurls 19, the base has a cylindrical crown 20 around which an annular channel 21 of the distribution chamber is formed while being interposed between the upstream portion 10*b* of the supply channel 10 and the upstream channels 11. Thus, the pressurised liquid coming from the feed tube passes into the supply channel 10 in order to fill the annular channel 21. Because of the changes in direction, the stream of liquid is then turbulent, and passes next into the upstream channels 11 inside of which it stabilises, and then accelerates in the downstream channels 12 before supplying the distribution channels 13.

In addition, in the embodiments shown, the downstream bearing surface 16*a* of the rod 16 has longitudinal grooves in which a downstream channel 12 is formed, respectively, said grooves being in communication with the upstream channels 11.

In the first embodiment (FIGS. 4 and 5), the knurls 19 have a truncated cone-shaped downstream region 19*b* which extends up to the radial joining surface between the base 15 and the rod 16, the complementary region of the end piece 7 being designed to form an intermediate channel 22, which is interposed between the upstream 11 and downstream 12 channels.

Figure 4:
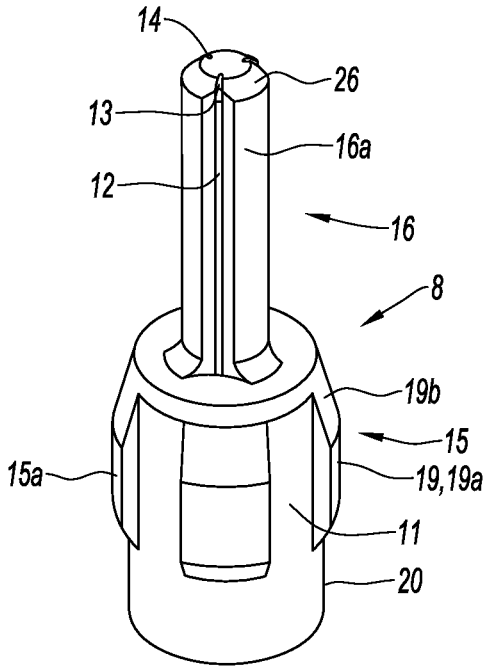
FIG. 4 is a perspective view of an insert according to a first embodiment of the invention.
Figure 5A:
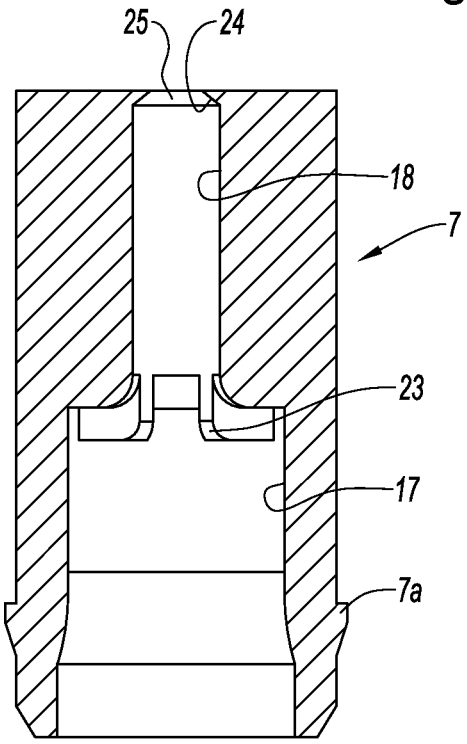
FIG. 5 are longitudinal sectional (FIG. 5*a*) and bottom (FIG. 5*b*) views, respectively, of an end piece intended to be mounted around the insert according to FIG. 4.
Figure 5B:
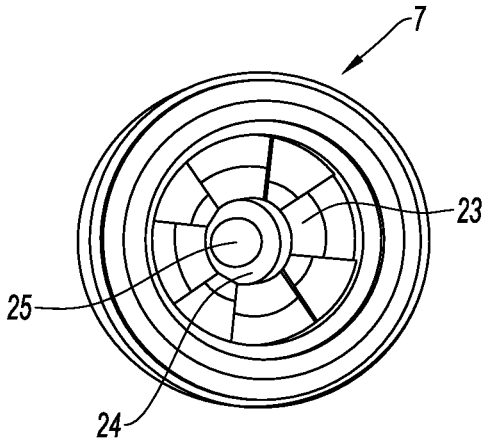
Figure 6:
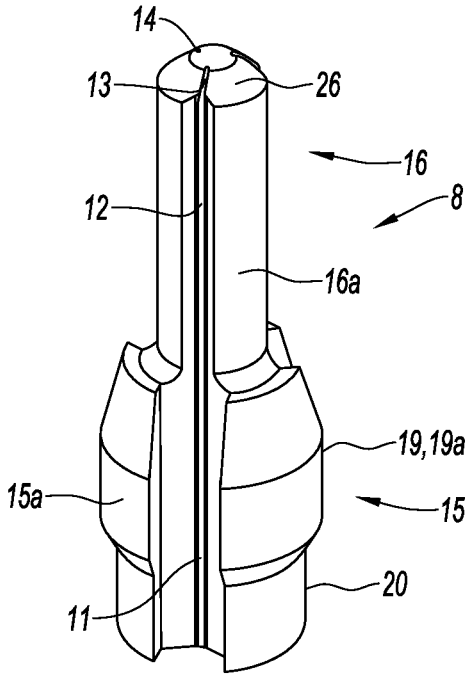
FIG. 6 is a perspective view of an insert according to a second embodiment of the invention.
Figure 7A:
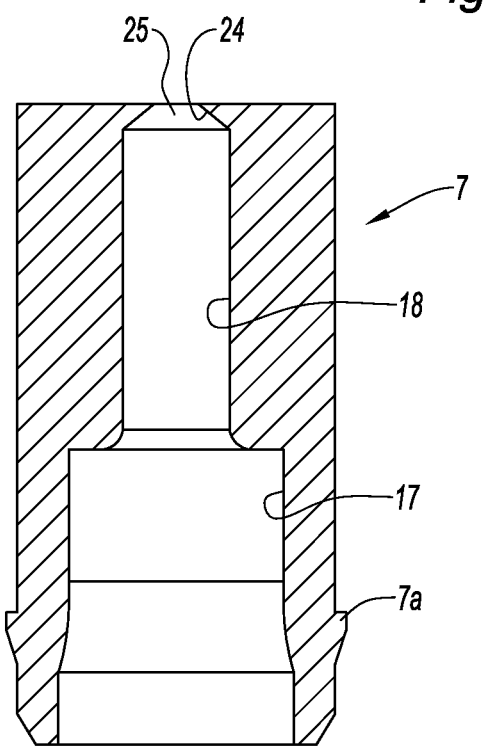
FIG. 7 are longitudinal sectional (FIG. 7*a*) and quarter-sectional (FIG. 7*b*) views, respectively, of an end piece intended to be mounted around the insert of FIG. 6.
Figure 7B:
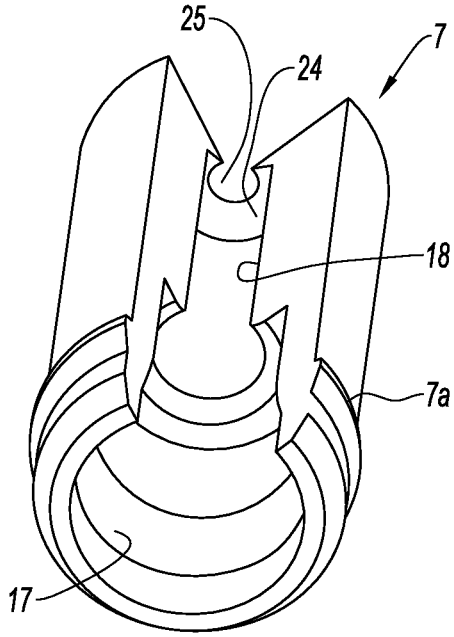

In particular, the joining region is annular so as to be capable of forming an annular intermediate channel 22 in which the upstream 11 and downstream 12 channels terminate. In FIGS. 4 and 5, the end piece 7 has integral bridges 23, which are designed to break up the annular channel so as to form several intermediate connecting channels 22 between the upstream 11 and downstream 12 channels.

Furthermore, the number of upstream channels 11 is different from that of the downstream channels 12, since four upstream channels 11 communicate with three downstream channels 12. According to the first embodiment, the difference in the transverse surface between the upstream and downstream areas is thus obtained by providing for more upstream channels 11 than downstream channels 12. As an alternative to this embodiment, an identical number of upstream 11 and downstream 12 channels can be formed and, as shown, the width of the upstream channels 11 is greater than that of the downstream channels 12, so as to increase the speed of the liquid from the upstream area to the downstream area of the distribution chamber.

In the second embodiment (FIGS. 6 and 7), the number of upstream channels 11 is equal to the number of downstream channels 12, each upstream channel 11 being in longitudinal alignment with a downstream channel 12, so as to limit the head loss at the junction between these channels 11, 12.

To accomplish this, the grooves of the rod 16 extend between the knurls 19, and the difference in transverse surface area between the area of the upstream 11 and downstream 12 channels is obtained by a greater depth of the upstream channels 11.

In the embodiments shown, the end of each downstream channel 12 has a truncated cone-shaped geometry, which is designed to form a distribution channel 13. The distribution channels 13, e.g. numbering three, are very small, e.g. having an approximate width of 60 μm and a depth of 70 μm for a device for withdrawing a 100-μl dose under a pressure of 5 bars.

More precisely, the end piece 7 has a seat 24 perforated with an opening 25 on which the end 26 of the rod 16 is butt-mounted, said seat and said end each having a truncated cone-shaped geometry so as to form the distribution channels 13 and the outlet openings 14 between said geometries.

Furthermore, in order to further increase the speed of the liquid jets dispensed by the outlet openings 14, it is possible to provide for the distribution channels 13 to have a cross-sectional area the transverse surface of which decreases from upstream to downstream.

Figure 9:
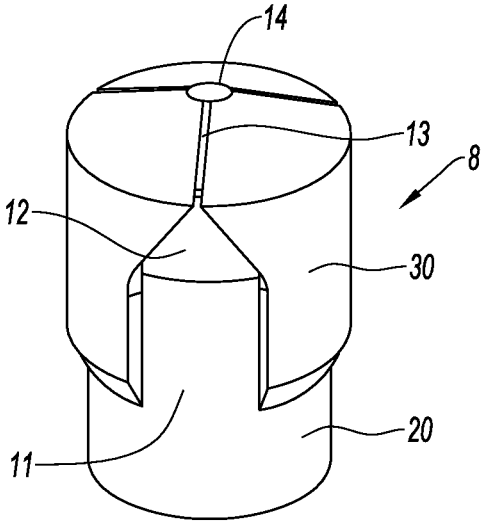
FIG. 9 is a perspective view of the insert of the push-button according to FIG. 8.
Figure 10:
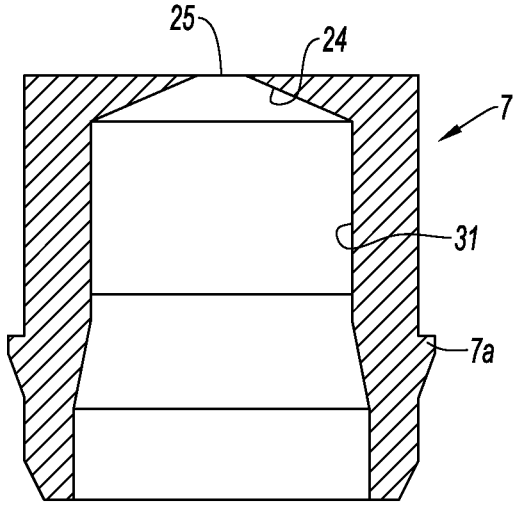
FIG. 10 is a longitudinal sectional view of the end piece intended to be mounted around the insert according to FIG. 9.

In connection with FIGS. 8 to 10, the upstream 11 and downstream 12 channels are formed as concave on a rotating cylindrical bearing surface 30 of the insert 8, said bearing surface having an outside diameter corresponding substantially to that of an inside bearing surface 31 of the end piece 7, so as to enable the centring and formation of the channels 11, 12 between said bearing surfaces.

In this embodiment, the difference in the average transverse surface between the cross-sectional area of the upstream 11 and downstream 12 channels is obtained by providing for the downstream channels 12 to have a variable width. In particular, in the embodiment shown, the transverse surface of the upstream cross-sectional area decreases from the transverse surface of the cross-sectional area of the upstream channels 11 to the transverse surface of the cross-sectional area of the distribution channels 13. As an alternative not shown, the depth of the upstream channels 11 can in addition be greater than that of the downstream channels 12, so as to further increase the difference in average transverse surface between the fluid flow areas in said channels.

In addition, as in the embodiments of FIGS. 1 to 7, the bearing surface 30 has a cylindrical crown 20 around which the annular channel 21 of the distribution chamber is formed. Furthermore, the end piece 7 has a seat 24 perforated with an opening 25 on which the end of the insert 8 is butt-mounted, said seat and said end each having a truncated cone-shaped geometry so as to form the distribution channels 13 and the outlet openings 14 between said geometries.

What is claimed is:

1. A push-button for a pressurised liquid distribution system, said push-button comprising a body onto which an end piece is mounted around an insert so as to form a distribution chamber between said end piece and said insert, said distribution chamber being in communication with a supply channel intended to be mounted on a feed tube for the pressurised liquid, said distribution chamber being successively connected to upstream channels, downstream channels and distribution channels, said distribution channels each converging towards one of a plurality of outlet openings while being designed to enable the impaction of the liquid jets dispensed by said outlet openings, the upstream and downstream channels extending longitudinally while forming an upstream and downstream fluid flow section, respectively, in the distribution chamber, said downstream section having an average cross-sectional area of which is less than the average cross-sectional area of the upstream section, characterized in that the upstream and downstream channels are formed at the interface between an interior wall of the end piece and an exterior wall of the insert, a concave impression is formed on at least one of said walls so as to be closed by the other wall while defining said channels, and each wall has at least one bearing surface between which the upstream and downstream channels are formed.

2. The push-button according to claim 1, characterised in that the distribution chamber further has an annular channel which is interposed between the supply channel and the upstream channels.

3. The push-button according to claim 1, characterised in that the number of downstream channels is equal to the number of upstream channels.

4. The push-button according to claim 3, characterised in that each downstream channel is in longitudinal alignment with an upstream channel.

5. The push-button according to claim 1, characterised in that each of the distribution channels have a cross-sectional area which decreases from upstream to down-stream.

6. The push-button according to claim 1, characterised in that the upstream and downstream channels are formed at the interface between an interior wall of the end piece and an exterior wall of the insert, a concave impression being formed on at least one of said walls so as to be closed by the other wall while defining said channels.

7. The push-button according to claim 1, characterised in that each wall has an upstream bearing surface between which the upstream channels are formed, and a downstream bearing surface between which the downstream channels are formed, the diameter of the upstream bearing surfaces being greater than the diameter of the downstream bearing surfaces.

8. The push-button according to claim 7, characterised in that the insert has a base over which a rod extends, the upstream channels being formed around the base and the downstream channels around the rod.

9. The push-button according to claim 1, characterised in that the downstream channels have a cross-sectional area which decreases from the cross-sectional area of the upstream channels to the cross-sectional area of the distribution channels.

10. The push-button according to claim 1, characterised in that the end piece has a seat in which the end of the insert is butt-mounted, said seat and said end each having a truncated cone-shaped geometry, said geometries being designed so as to form the distribution channels and the outlet openings therebetween.

11. The push-button according to claim 1, characterised in that the downstream end of each downstream channel has a truncated cone-shaped geometry designed to form a distribution channel.

12. The push-button according to claim 1, characterised in that the distribution chamber further has at least one intermediate channel, which is interposed between the upstream and downstream channels.

13. The push-button according to claim 12, characterised in that the intermediate channel is annular, the upstream and downstream channels terminating in said annular channel.

14. The push-button according to claim 13, characterised in that the distribution chamber has several intermediate channels connecting the upstream and downstream channels.

15. The push-button according to claim 1, characterised in that the body has a housing in which the insert is arranged, the end piece being connected inside said housing.

16. A pressurised liquid distribution system, comprising a pressurised device for withdrawing the liquid on which is mounted a push-button according to any claim 1, the distribution chamber being in communication with the feed tube for the pressurised liquid coming from said withdrawing device, so as to enable the liquid to be sprayed via impaction of the jets coming from the distribution channels.

* * * * *